US011210999B2

(12) United States Patent
Yamashita et al.

(10) Patent No.: US 11,210,999 B2
(45) Date of Patent: Dec. 28, 2021

(54) DISPLAY SYSTEM, DRIVING APPARATUS AND DRIVING METHOD FOR DISPLAY DEVICE

(71) Applicant: Everdisplay Optronics (Shanghai) Co., Ltd., Shanghai (CN)

(72) Inventors: Keitaro Yamashita, Shanghai (CN); Shaodong Ma, Shanghai (CN); Shanglong Wang, Shanghai (CN); Fei Shen, Shanghai (CN)

(73) Assignee: Everdisplay Optronics (Shanghai) Co., Ltd, Shanghai (CN)

( * ) Notice: Subject to any disclaimer, the term of this patent is extended or adjusted under 35 U.S.C. 154(b) by 0 days.

(21) Appl. No.: 17/027,959

(22) Filed: Sep. 22, 2020

(65) Prior Publication Data

US 2021/0142723 A1 May 13, 2021

(30) Foreign Application Priority Data

Nov. 12, 2019 (CN) ..... 201911111416.X

(51) Int. Cl.
*G09G 3/3225* (2016.01)

(52) U.S. Cl.
CPC ... *G09G 3/3225* (2013.01); *G09G 2300/0842* (2013.01); *G09G 2320/045* (2013.01); *G09G 2320/064* (2013.01); *G09G 2360/16* (2013.01)

(58) Field of Classification Search
CPC ..... G09G 2360/16; G09G 2320/045; G09G 2320/064
See application file for complete search history.

(56) References Cited

U.S. PATENT DOCUMENTS

2010/0085341 A1* 4/2010 Hasegawa ..... G09G 3/3258 345/208
2014/0055509 A1* 2/2014 Hasegawa ..... G09G 3/3233 345/691

(Continued)

FOREIGN PATENT DOCUMENTS

CN 103021335 A 4/2013
CN 103151005 A 6/2013

(Continued)

OTHER PUBLICATIONS

The 1st Office Action dated Oct. 9, 2021 for CN patent application No. 201911111416.X.

*Primary Examiner* — Sepehr Azari
(74) *Attorney, Agent, or Firm* — Qinghong Xu

(57) ABSTRACT

A driving method includes: determining a starting luminance $L_S$ of a to-be-adjusted frame image; determining an average luminance $L_{AVE}(n)$ of the to-be-adjusted frame image during a nth duty period; determining a reference luminance flow rate $\Delta L$ that indicates a current change rate of a storage capacitor storing a data signal for a display element; determining a time length $T_F$ of a reference frame image; determining a number k of black strips in the to-be-adjusted frame image; calculating a duty ratio of a pulse driving signal of the to-be-adjusted frame image during the nth duty period based on the starting luminance $L_S$, the average luminance $L_{AVE}(n)$, the reference luminance flow rate $\Delta L$, the time length $T_F$, and the number k of the black strips; and driving to display the to-be-adjusted frame image by the adjusted pulse driving signal.

10 Claims, 4 Drawing Sheets

(56) References Cited

U.S. PATENT DOCUMENTS

| | | | | |
|---|---|---|---|---|
| 2016/0189620 | A1* | 6/2016 | Park | G09G 3/3258 345/690 |
| 2017/0249901 | A1* | 8/2017 | Nakamura | G09G 3/3258 |

FOREIGN PATENT DOCUMENTS

| | | | |
|---|---|---|---|
| CN | 106205497 | A | 12/2016 |
| CN | 107086025 | A | 8/2017 |
| CN | 107968939 | A | 4/2018 |
| CN | 110379368 | A | 10/2019 |

* cited by examiner

DISPLAY SYSTEM, DRIVING APPARATUS AND DRIVING METHOD FOR DISPLAY DEVICE

CROSS-REFERENCE TO RELATED APPLICATIONS

The present application is based upon and claims priority to Chinese patent application No. 201911111416.X, filed on Nov. 12, 2019, the entire disclosure of which is incorporated herein by reference.

TECHNICAL FIELD

The present disclosure relates to the field of display technology, and in particular, to a display system, a driving apparatus and a driving method for a display device.

BACKGROUND

In recent years, an Organic Light-Emitting Diode (OLED) technology has developed rapidly and has become the most promising technology to replace a Liquid Crystal Display (LCD).

At present, in order to avoid a smear phenomenon in displaying pictures, a black insertion technology is generally used in driving an OLED. The black insertion refers to that during a display period of a frame, part of the pixels are controlled not to emit light in a period of time and to emit light normally at other times. As such, since a light emission control signal progressively scans each row of pixels in an order from top to bottom, from the perspective of the entire display device, at any timing, there are always strips of pixels that do not emit light while other pixels emit light.

In the prior art, a driving circuit for each sub-pixel in an OLED display includes a storage capacitor in which charges are stored to maintain a voltage within a frame period. The voltage of the storage capacitor defines a data signal of the OLED for a next frame period. Ideally, the storage capacitor should maintain the same pixel voltage for the frame period. However, the pixel voltage may gradually drift due to a leakage current through a thin film transistor coupled to the storage capacitor. In this case, the current of the OLED will also change with the drift of the voltage of the storage capacitor, and eventually the display luminance will drift over time.

SUMMARY

According to a first aspect of the present disclosure, there is provided a driving method for a display device, including:

determining a starting luminance $L_S$ of a to-be-adjusted frame image;

determining an average luminance $L_{AVE}(n)$ of the to-be-adjusted frame image during a nth duty period, where n denotes an integer greater than 1:

determining a reference luminance flow rate $\Delta L$ that indicates a current change rate of a storage capacitor that stores a data signal for a display element;

determining a time length $T_F$ of a reference frame image:

determining a number k of black strips in the to-be-adjusted frame image, where k denotes an integer greater than 1;

adjusting a duty ratio of a pulse driving signal of the to-be-adjusted frame image during the nth duty period based on the starting luminance $L_S$ of the to-be-adjusted frame image, the average luminance $L_{AVE}(n)$ of the to-be-adjusted frame image during the nth duty period, the reference luminance flow rate $\Delta L$, the time length $T_F$ of the reference frame image, and the number k of black strips in the to-be-adjusted frame image; and driving to display the to-be-adjusted frame image by the adjusted pulse driving signal.

In an embodiment of the present disclosure, the duty ratio of the pulse driving signal of the to-be-adjusted frame image during the nth duty period is calculated according to the following formula:

$$D_n = \frac{-\beta n - L_S + \sqrt{(\beta n + L_S)^2 + 2\ \beta\ L_{AVE}(n)}}{\beta} (0 \le D_n \le 1)$$

$$\text{where } \beta = \frac{\Delta L T_F}{k}.$$

In an embodiment of the present disclosure, the reference luminance flow rate $\Delta L$ is determined by measurement.

In an embodiment of the present disclosure, in a plurality of to-be-adjusted frame images, the number k of black strips is different for at least part of the to-be-adjusted frame images.

In an embodiment of the present disclosure, the method is applied to a display device with a variable refresh rate.

In an embodiment of the present disclosure, the method is applied to a display device with a frame rate less than 60 Hz.

In an embodiment of the present disclosure, the storage capacitor that stores the data signal for the display element includes one, two, or three storage capacitors.

According to another aspect of the present disclosure, there is further provided a driving apparatus for a display device, including:

a determining module configured to:

determine a starting luminance $L_S$ of a to-be-adjusted frame image;

determine an average luminance $L_{AVE}(n)$ of the to-be-adjusted frame image during a nth duty period, where n denotes an integer greater than 1;

determine a reference luminance flow rate $\Delta L$ that indicates a current change rate of a storage capacitor that stores a data signal for a display element;

determine a time length $T_F$ of a reference frame image;

determine a number k of black strips in the to-be-adjusted frame image, where k denotes an integer greater than 1;

an adjusting module configured to adjust a duty ratio of a pulse driving signal of the to-be-adjusted frame image during the nth duty period based on the starting luminance $L_S$ of the to-be-adjusted frame image, the average luminance $L_{AVE}(n)$ of the to-be-adjusted frame image during the nth duty period, the reference luminance flow rate $\Delta L$, the time length $T_F$ of the reference frame image, and the number k of black strips in the to-be-adjusted frame image; and a driving module configured to drive to display the to-be-adjusted frame image by the adjusted pulse driving signal.

According to another aspect of the present disclosure, there is further provided a display system, including:

the driving apparatus for the display device as described above; and the display device.

In an embodiment of the present disclosure, the storage capacitor that stores the data signal for the display element includes one, two or three storage capacitors.

BRIEF DESCRIPTION OF THE DRAWINGS

The above and other features and advantages of the present disclosure will become more apparent from the detailed description of exemplary embodiments thereof with reference to the accompanying drawings.

DETAILED DESCRIPTION

Figure 1:
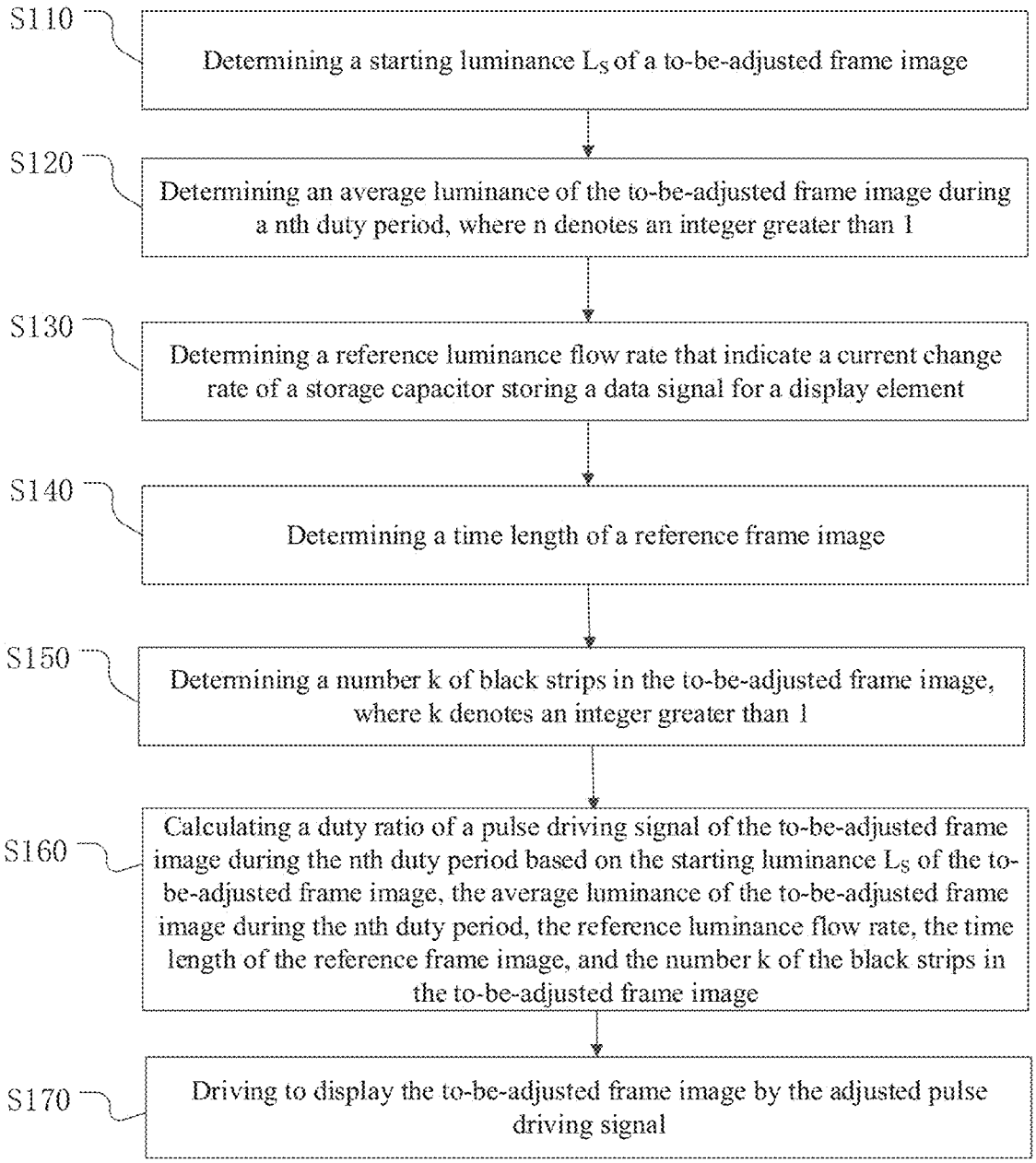
FIG. 1 shows a flowchart of a driving method for a display device according to an embodiment of the present disclosure.

Exemplary embodiments will now be described more fully with reference to the accompanying drawings. However, the exemplary embodiments may be embodied in various forms and should not be construed as being limited to the implementations set forth herein; rather, these embodiments are provided so that this disclosure will be more comprehensive and complete, and will fully convey the concept of the exemplary embodiments to those skilled in the art. The same reference numerals in the drawings represent the same or similar structures, and the repeated description thereof will be omitted.

The described features, structures, or characteristics may be combined in any suitable manner in one or more embodiments. In the description below, numerous specific details are set forth to provide a thorough understanding of the embodiments of the present disclosure. However, those skilled in the art will appreciate that the technical solutions of the present disclosure can also be practiced without one or more of the specific details, or with other methods, components, materials, or the like. In some instances, well-known structures, materials or operations are not shown or described in detail to avoid obscuring aspects of the present disclosure.

The drawings of the present disclosure are only used to illustrate the relative positional relationship. The dimensions of some parts are exaggerated for ease of understanding. The dimensions in the drawings do not represent the proportional relationship of the actual dimensions.

Figure 2:
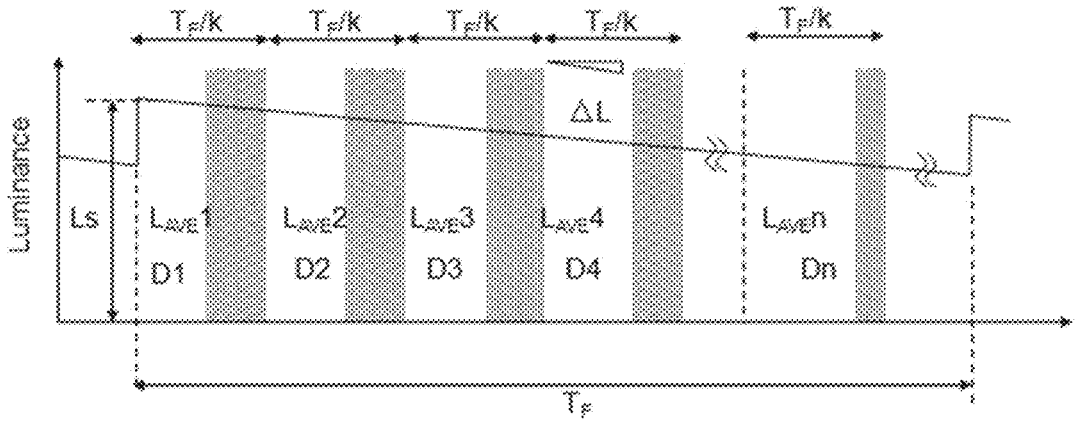
FIG. 2 is a diagram illustrating a luminance change of a frame image in n duty periods according to an embodiment of the present disclosure.
Figure 3:
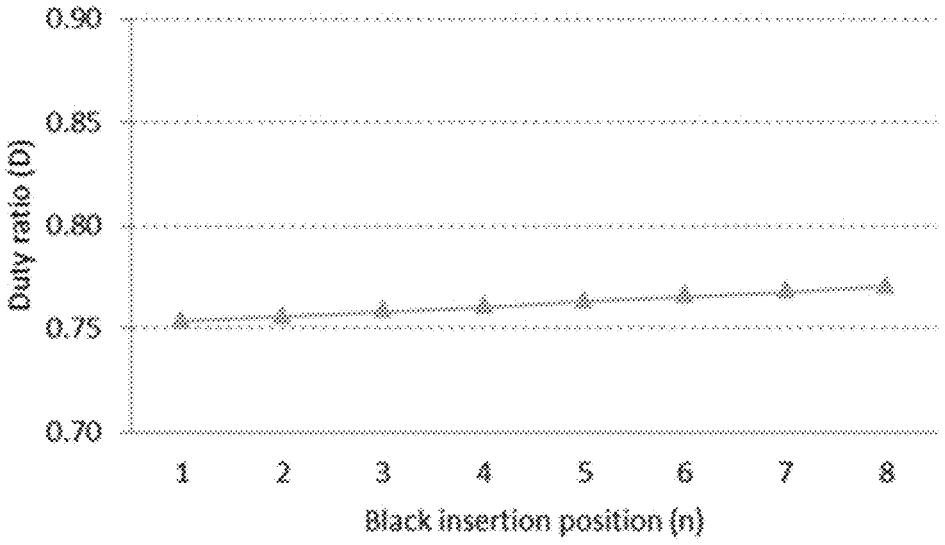
FIG. 3 is a schematic diagram showing a duty ratio in each duty period after adjustment according to an embodiment of the present disclosure.
Figure 4:
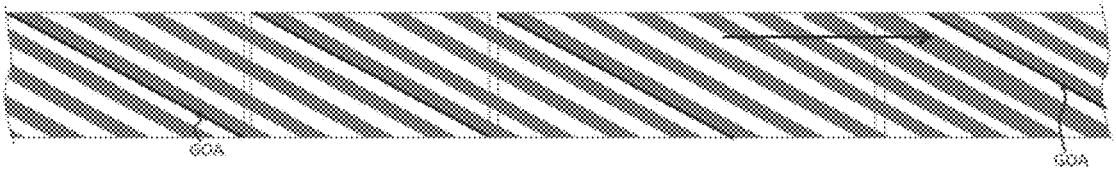
FIG. 4 shows a light emission timing chart of reducing the duty ratio according to a specific embodiment of the present disclosure.
Figure 5:
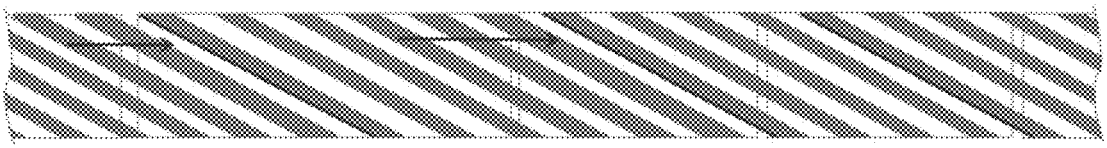
FIG. 5 shows a light emission timing chart of increasing the duty ratio according to another embodiment of the present disclosure.
Figure 6:
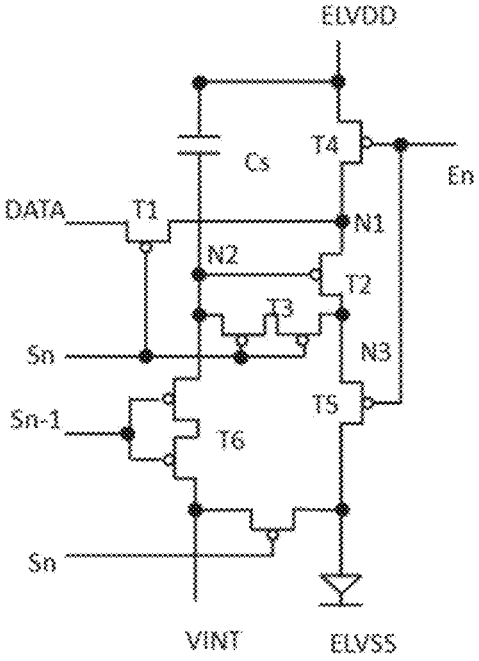
FIG. 6 is a schematic diagram of a pixel circuit according to a specific embodiment of the present disclosure.

Firstly, a driving method for a display device according to an embodiment of the present disclosure is described with reference to FIGS. 1 to 6. FIG. 1 shows a flowchart of a driving method for a display device according to an embodiment of the present disclosure. FIG. 2 is a diagram illustrating a luminance change of a frame image in n duty periods according to an embodiment of the present disclosure. FIG. 3 is a schematic diagram showing the duty ratio in each duty period after adjustment according to an embodiment of the present disclosure. FIG. 4 shows a light emission timing chart of reducing a duty ratio according to a specific embodiment of the present disclosure. FIG. 5 shows a light emission timing chart of increasing the duty ratio according to another embodiment of the present disclosure. FIG. 6 is a schematic diagram of a pixel circuit according to a specific embodiment of the present disclosure.

FIG. 1 shows the following steps.

In step S110, a starting luminance $L_S$ of a to-be-adjusted frame image is determined.

In step S120, an average luminance $L_{AVE}(n)$ of the to-be-adjusted frame image during the nth duty period is determined, where n is an integer greater than 1.

In step S130, a reference luminance flow rate $\Delta L$ is determined, the reference luminance flow rate indicating a current change rate of a storage capacitor that stores a data signal for a display element.

In step S140, a time length $T_F$ of the reference frame image is determined.

In step S150, the number k of black strips in the to-be-adjusted frame image is determined, where k denotes an integer greater than 1.

In step S160, a duty ratio of a pulse driving signal of the to-be-adjusted frame image during the nth duty period is calculated based on the starting luminance $L_S$ of the to-be-adjusted frame image, the average luminance $L_{AVE}(n)$ of the to-be-adjusted frame image during the nth duty period, the reference luminance flow rate $\Delta L$, the time length $T_F$ of the reference frame image, and the number k of black strips in the to-be-adjusted frame image.

In step S170, the to-be-adjusted frame image is driven to be displayed by the adjusted pulse driving signal.

The adjusted duty ratio is as shown in FIG. 4 or FIG. 5. In FIG. 4, the duty ratio of the pulse driving signal is adjusted to be reduced and accordingly a width of the black strip is adjusted to be increased, so as to deal with the situation where the luminance is increased due to the current flowing into the storage capacitor. In FIG. 5, the duty ratio of the pulse driving signal is adjusted to be increased and accordingly the width of the black strip is adjusted to be reduced, so as to deal with the situation where the luminance is reduced due to the current flowing out of the storage capacitor.

In the driving method for the display device provided in the present disclosure, steps S110 to S150 can be performed synchronously, partly synchronously, or asynchronously. In the embodiments of asynchronous execution, it is not limited to the execution order of steps S110 to S150. For example, step S150 may be performed first, and then steps S130, S120, S140, and S110 may be performed. The execution order of steps S110 to S150 is not limited in the present disclosure.

Referring to FIG. 2, the luminance L(t) at any time point t in a frame image can be calculated according to the following formula:

$$L(t)=\Delta L\cdot t+L_S$$

wherein $\Delta L$ denotes a reference luminance flow rate which is used to indicate a current change rate of the storage capacitor that stores the data signal for the display element. The reference luminance flow rate $\Delta L$ is determined through measurement. $L_S$ denotes the starting luminance of the to-be-adjusted frame image.

The average luminance $L_{AVE}(n)$ of the to-be-adjusted frame image during the nth duty period can be expressed in the following formula:

$$L_{AVE}(n) = \frac{D_n}{2}(L_{An} + L_{Bn})$$

where $D_n$ denotes the duty ratio of the pulse driving signal of the to-be-adjusted frame image during the nth duty period, $L_{An}$ denotes the luminance of the to-be-adjusted frame image at the beginning of the light emission period during the nth duty period, and $L_{Bn}$ denotes the luminance of the to-be-adjusted frame image at the end of the light emission period during the nth duty period.

Accordingly, by replacing the luminance $L_{An}$ of the to-be-adjusted frame image at the beginning of the light emission period during the nth duty period and the luminance $L_{Bn}$ of the to-be-adjusted frame image at the ending of the light emission period during the nth duty period based on the parameters such as the reference luminance flow rate ΔL, the starting luminance $L_S$ of the to-be-adjusted frame image, etc., the average luminance $L_{AVE}(n)$ of the to-be-adjusted frame image during the nth duty period can be expressed in the following formula:

$$L_{AVE}(n) = \frac{D_n}{2}\left[\left\{\frac{\Delta LT_F n}{k} + L_S\right\} + \left\{\frac{\Delta LT_F(n + D_n)}{k} + L_S\right\}\right] = \frac{D_n}{2}\left\{\frac{\Delta LT_F}{k}(2n + D_n) + 2L_S\right\}$$

Thus, the above formula can be converted into the following formula for calculating the duty ratio of the pulse driving signal of the to-be-adjusted frame image during the nth duty period:

$$D_n = \frac{-\beta n - L_S + \sqrt{(\beta n + L_S)^2 + 2\beta L_{AVE}(n)}}{\beta} (0 \le D_n \le 1)$$

where $\beta = \frac{\Delta LT_F}{k}$.

In a specific embodiment, it is assumed that k=8, ΔL=−10 nit/frame (−602.41 [nit/second]), $L_{AVE}$=300 nit, $L_{AVE}(n)$ in the above formula represents the same meaning as that of $L_{AVE}$, $L_S$=400 nit, and $T_F$=16.666 milliseconds (60 Hz), and the duty ratios D1 to D8 of the eight duty periods calculated according to the above formula are: D1=0.753240; D2=0.755615; D3=0.758004; D4=0.760409; D5=0.762828; D6=0.765264; D7=0.767715; and D8=0.770181. The duty ratios D1 to D8 of the eight duty periods which are obtained by calculation and adjustment are shown in FIG. 3.

In the foregoing embodiments of the present disclosure, for a plurality of to-be-adjusted frame images, the number k of the black strips is different for at least a part of the to-be-adjusted frame images. The present disclosure is not limited thereto, and the number k of the black strips in each of the to-be-adjusted frame images may also be the same, or may be set according to specific requirements.

Furthermore, the driving method is applicable to a display device with a variable refresh rate, and is particularly applicable to a display device with a frame rate less than 60 Hz.

In an embodiment of the present disclosure, the number of the storage capacitors storing the data signal for the display element is one, two, or three. A pixel driving circuit according to a specific embodiment of the present disclosure is shown in FIG. 6, in which T3 and T6 denote the storage capacitors of the display element that store the data signal. FIG. 6 schematically illustrates an implementation of the pixel driving circuit of the present disclosure.

The above is only a schematic description of the driving method for the display device provided by the present disclosure, and the present disclosure is not limited thereto.

Figure 7:
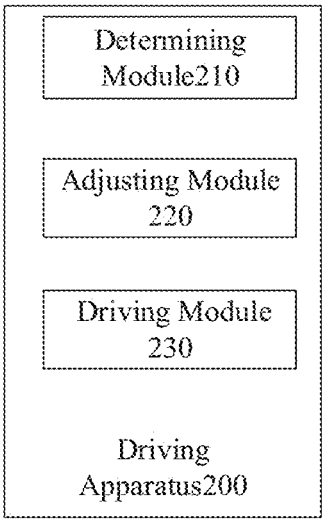
FIG. 7 shows a block diagram of a driving apparatus for a display device according to an embodiment of the present disclosure.

Reference is now made to FIG. 7, which illustrates a block diagram of a driving apparatus of a display device according to an embodiment of the present disclosure. The driving apparatus 200 of the display device includes a determining module 210, an adjusting module 220, and a driving module 230.

The determining module 210 is configured to: determine a starting luminance $L_S$ of a to-be-adjusted frame image; determine an average luminance $L_{AVE}(n)$ of the to-be-adjusted frame image during a nth duty period, where N denotes an integer greater than 1; determine a reference luminance flow rate ΔL that indicates a current change rate of a storage capacitor that stores a data signal for a display element; determine a time length $T_F$ of the reference frame image; and determine a number k of black strips in the to-be-adjusted frame image, where k denotes an integer greater than 1. The adjusting module 220 is configured to calculate a duty ratio of a pulse driving signal of the to-be-adjusted frame image during the nth duty period based on the starting luminance $L_S$ of the to-be-adjusted frame image, the average luminance $L_{AVE}(n)$ of the to-be-adjusted frame image during the nth duty period, the reference luminance flow rate ΔL, the time length $T_F$ of the reference frame image, and the number k of the black strips in the to-be-adjusted frame image. The driving module 230 is configured to drive to display the to-be-adjusted frame image by the adjusted pulse driving signal.

The above block diagram schematically illustrates merely modules of the embodiments of the present disclosure. Without deviating from the concept of the present disclosure, combinations and divisions of the modules are all within the protection scope of the present disclosure. The modules can be implemented in software, hardware, firmware, or any combination thereof.

Figure 8:
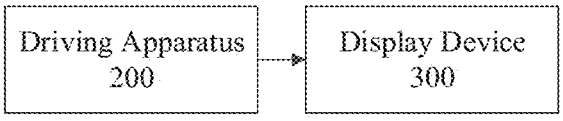
FIG. 8 is a schematic diagram of a display system according to an embodiment of the present disclosure.

Referring to FIG. 8, according to another aspect of the present disclosure, a display system is further provided. The display system includes a driving apparatus and a display device. The driving apparatus is as shown in FIG. 7. The display device can preferably be an OLED display device, but the present disclosure is not limited thereto, and display devices with other technologies also fall within the protection scope of the present disclosure.

According to an embodiment of the present disclosure, the driving apparatus 200 can includes a processor which can invoke and execute a computer program from a memory to implement the driving methods in the embodiments of the present disclosure.

Optionally, the driving apparatus 200 can further include the memory from which the processor can invoke and execute the computer program to implement the driving methods in the embodiments of the present disclosure. The memory can be a separate device independent of the processor, or can be integrated in the processor.

The above embodiments and variations are merely used to illustratively describe the basic concept of the present disclosure. Those skilled in the art may implement more variations which all fall within the protection scope of the present disclosure without departing from the basic concept of the present disclosure.

Compared with the prior art, in the present disclosure, the duty ratio of the pulse drive signal of the to-be-adjusted frame image during the nth duty period is calculated by using the reference luminance flow rate indicating the current change rate of the storage capacitor that stores data signals for the display element in combination with the starting luminance $L_S$ of the to-be-adjusted frame image, the average luminance $L_{AVE}$ (n) of the current frame image during the nth each duty period, the time length $T_F$ of the reference frame image, and the number k of black strips in the to-be-adjusted frame image, thereby dynamically adjusting the duty ratio of the pulse driving signal to compensate for the drift of the luminance over time caused by the voltage drift of the storage capacitor so as to maintain the constant luminance.

The exemplary embodiments of the present disclosure have been specifically described above. It should be understood that the present disclosure is not limited to the disclosed embodiments, rather, the disclosure is intended to cover various modifications and equivalent replacements which are embraced within the scope of the appended claims.

What is claimed is:

1. A driving method for a display device, comprising:

determining a starting luminance $L_S$ of a to-be-adjusted frame image;

determining an average luminance $L_{AVE}$(n) of a to-be-adjusted frame image during a nth duty period, where N denotes an integer greater than 1;

determining a reference luminance flow rate ΔL that indicates a current change rate of a storage capacitor storing a data signal for a display element;

determining a time length $T_F$ of a reference frame image;

determining a number k of black strips in the to-be-adjusted frame image, where k denotes an integer greater than 1;

adjusting a duty ratio of a pulse driving signal of the to-be-adjusted frame image during the nth duty period based on the starting luminance $L_S$ of the to-be-adjusted frame image, the average luminance $L_{AVE}$(n) of the to-be-adjusted frame image during the nth duty period, the reference luminance flow rate ΔL, the time length $T_F$ of the reference frame image, and the number k of the black strips in the to-be-adjusted frame image; and driving to display the to-be-adjusted frame image by the adjusted pulse driving signal.

2. The driving method for the display device according to claim 1, wherein the duty ratio of the pulse driving signal of the to-be-adjusted frame image during the nth duty period is calculated according to the following formula:

$$D_n = \frac{-\beta n - L_S + \sqrt{(\beta n + L_S)^2 + 2\beta L_{AVE}(n)}}{\beta} (0 \le D_n \le 1)$$

where $\beta = \frac{\Delta L T_F}{k}$.

3. The driving method for the display device according to claim 1, wherein the reference luminance flow rate ΔL is determined through measurement.

4. The driving method for the display device according to claim 1, wherein in a plurality of to-be-adjusted frame images, the number k of black strips is different for at least a part of the to-be-adjusted frame images.

5. The driving method for the display device according to claim 1, wherein the method is applied to the display device with a variable refresh rate.

6. The driving method for the display device according to claim 1, wherein the method is applied to the display device having a frame rate less than 60 Hz.

7. The driving method for the display device according to claim 1, wherein the storage capacitors storing the data signal for the display element comprises one, two, or three storage capacitors.

8. A driving apparatus for a display device, comprising:

a processor; and a memory for storing executable instructions of the processor, wherein the processor is configured to revoke and execute the instructions stored in the memory to cause the driving apparatus to:

determine a starting luminance $L_S$ of a to-be-adjusted frame image;

determine an average luminance $L_{AVE}$(n) of the to-be-adjusted frame image during a nth duty period, where N denotes an integer greater than 1;

determine a reference luminance flow rate ΔL that indicates a current change rate of a storage capacitor storing a data signal for a display element;

determine a time length $T_F$ of a reference frame image; and determine a number k of black strips in the to-be-adjusted frame image, where k denotes an integer greater than 1;

adjust a duty ratio of a pulse driving signal of the to-be-adjusted frame image during the nth duty period based on the starting luminance $L_S$ of the to-be-adjusted frame image, the average luminance $L_{AVE}$(n) of the to-be-adjusted frame image during the nth duty period, the reference luminance flow rate ΔL, the time length $T_F$ of the reference frame image, and the number k of the black strips in the to-be-adjusted frame image; and drive to display the to-be-adjusted frame image by the adjusted pulse driving signal.

9. A display system, comprising:

the driving apparatus of the display device according to claim 8; and the display device.

10. The display system according to claim 9, wherein the storage capacitors storing the data signal for the display element comprises one, two, or three storage capacitors.

* * * * *